US005534909A

United States Patent [19]

Hanabusa et al.

[11] Patent Number: 5,534,909

[45] Date of Patent: Jul. 9, 1996

[54] RECORDING APPARATUS REGULATING THERMAL HEAD POWER AND INK SHEET PEELING ANGLE

[75] Inventors: Tadashi Hanabusa, Zushi; Nobuyuki Kuwabara, Tokyo, both of Japan

[73] Assignee: Canon Kabushiki Kaisha, Tokyo, Japan

[21] Appl. No.: 837,597

[22] Filed: Feb. 20, 1992

Related U.S. Application Data

[63] Continuation of Ser. No. 313,516, Feb. 22, 1989, abandoned.

[30] Foreign Application Priority Data

Feb. 25, 1988 [JP] Japan ..... 63-40677

[51] Int. Cl.[6] ..... B41J 35/20

[52] U.S. Cl. ..... 347/216; 347/192; 347/198

[58] Field of Search ..... 346/76 PH; 400/120, 400/248, 120.12, 120.17; 347/192, 198, 215, 216, 217, 218

[56] References Cited

U.S. PATENT DOCUMENTS

| | | | |
|---|---|---|---|
| 4,750,007 | 6/1988 | Suzuki | 346/76 PH |
| 4,784,502 | 11/1988 | Kobayashi | 400/248 |
| 4,855,758 | 8/1989 | Kuwabara et al. | 346/76 PH |
| 4,870,428 | 9/1989 | Kuwabara et al. | 346/76 PH |
| 4,879,566 | 11/1989 | Hanabusa | 346/76 PH |
| 5,175,563 | 12/1992 | Fushimoto et al. | 346/76 PH |

*Primary Examiner*—Huan H. Tran

*Attorney, Agent, or Firm*—Fitzpatrick, Cella, Harper & Scinto

[57] ABSTRACT

A thermal recording apparatus for image recording by ink transfer from an ink sheet, provided with devices for regulating the peeling angle of the ink sheet from the recording sheet and for regulating electric power supplied to the thermal head, is disclosed. These devices are regulated according to the kind, particularly smoothness, of the recording sheet to achieve optimum recording in any sheet.

18 Claims, 7 Drawing Sheets

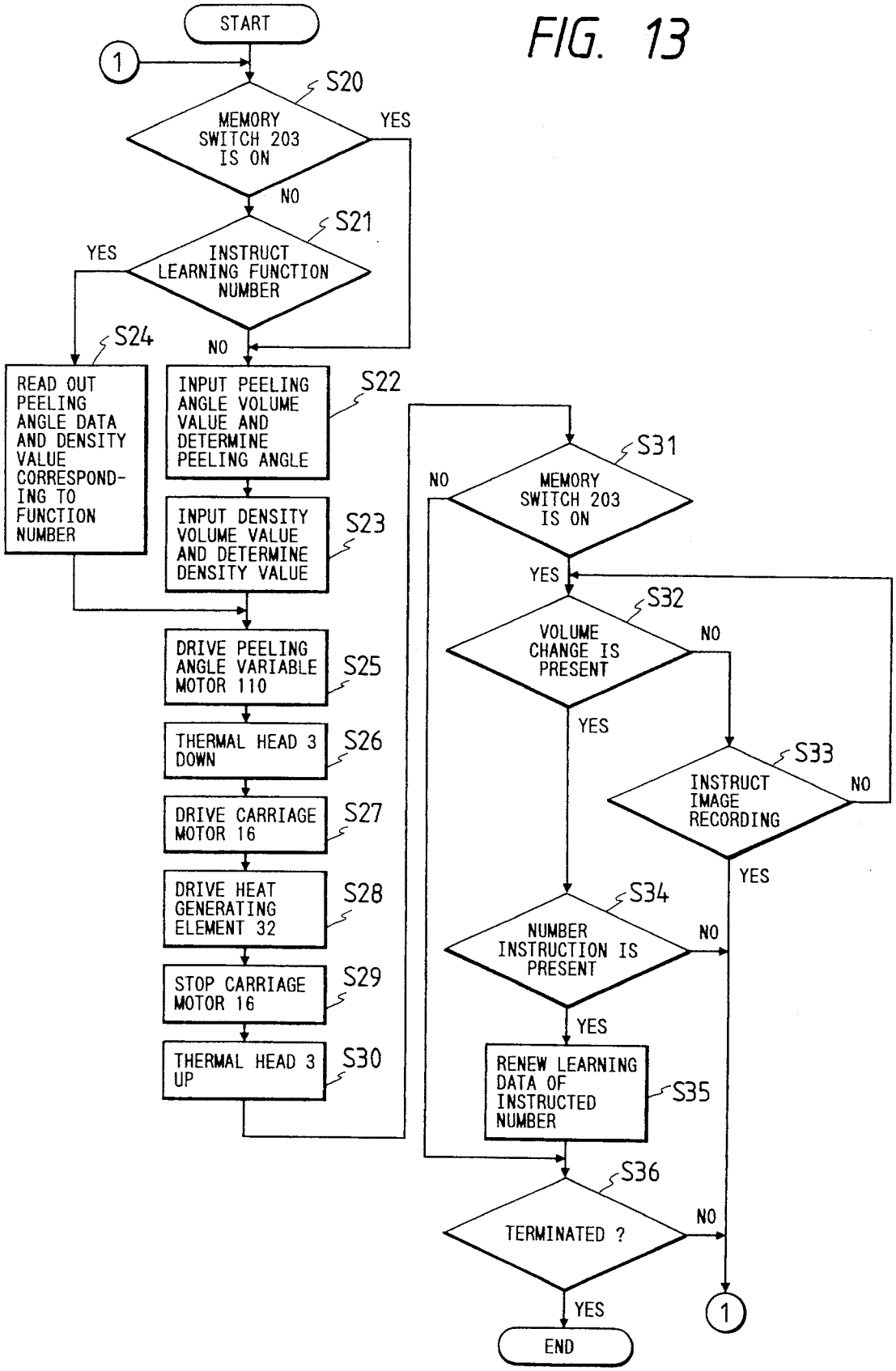
FIG. 13
START
1
S20
MEMORY SWITCH 203 IS ON
YES
NO
S21
INSTRUCT LEARNING FUNCTION NUMBER
YES
NO
S24
READ OUT PEELING ANGLE DATA AND DENSITY VALUE CORRESPOND-ING TO FUNCTION NUMBER
INPUT PEELING ANGLE VOLUME VALUE AND DETERMINE PEELING ANGLE
S22
INPUT DENSITY VOLUME VALUE AND DETERMINE DENSITY VALUE
S23
DRIVE PEELING ANGLE VARIABLE MOTOR 110
S25
THERMAL HEAD 3 DOWN
S26
DRIVE CARRIAGE MOTOR 16
S27
DRIVE HEAT GENERATING ELEMENT 32
S28
STOP CARRIAGE MOTOR 16
S29
THERMAL HEAD 3 UP
S30
S31
MEMORY SWITCH 203 IS ON
NO
YES
S32
VOLUME CHANGE IS PRESENT
NO
YES
S33
INSTRUCT IMAGE RECORDING
NO
YES
S34
NUMBER INSTRUCTION IS PRESENT
NO
YES
RENEW LEARNING DATA OF INSTRUCTED NUMBER
S35
S36
TERMINATED ?
NO
YES
END
1

RECORDING APPARATUS REGULATING THERMAL HEAD POWER AND INK SHEET PEELING ANGLE

This application is a continuation of application Ser. No. 07/313,516 filed Feb. 22, 1989, now abandoned.

BACKGROUND OF THE INVENTION

1. Field of the Invention

The present invention relates to an image recording apparatus for recording an image on a recording medium, and more particularly to an image recording apparatus for achieving said image recording by transferring ink from an ink sheet bearing ink thereon to the recording medium.

Such image recording apparatus includes printers, electronic typewriters, copying machines, word processors, facsimile machines or the like.

2. Related Background Art

Thermal recording apparatus employed in printers, facsimile machines or copying machines generate dot patterns on a recording medium of sheet form such as paper or a plastic sheet, by selectively generating heat in plural dot forming elements provided in a thermal head, according to image data to be recorded. This category of recording apparatus can be divided into a serial printer type in which recording is made by the movement of the recording head in lateral direction of the recording sheet, a line printer type in which recording of one line is made at the same time, or a page printer type in which recording of one page is made at the same time. Also such thermal recording apparatus can be divided into a thermal transfer type in which ink is transferred from an ink ribbon onto a plain paper, and a thermal type in which color is generated by direct heating of a heat sensitive paper with a thermal head.

Such a thermal transfer recording apparatus employs an ink sheet composed of thermal transfer ink containing a coloring material such as carbon black. The ink is coated on a substrate sheet for example of polyethylene terephthalate (PET) and the binder of said thermal transfer ink has been principally composed of waxes. In such case, as the fusion viscosity of the thermal transfer ink is lowered, the fused ink and the surface of the recording sheet have to be in mutual contact at the ink transfer when heat is applied. However, a recording sheet with low surface smoothness reduces the probability or area of contact thereof with the fused ink, so that the ink cannot reach the recesses on the surface of the recording sheet. This phenomenon has resulted often in print break or incomplete edge sharpness.

Therefore, for the purpose of obtaining a satisfactory transferred image even on a recording sheet with low surface smoothness as referred to "rough paper" hereinafter, it has been proposed to employ thermal transfer ink principally composed of a resin with relatively high fusion viscosity, for example ethylene-vinyl acetate copolymer or polyamide and to transfer the ink in a semi-fused film state onto the rough paper. In such method, as the thermal transfer ink has to be peeled off from the substrate sheet while in a state of high coagulating force in order to retain the film state, it is preferable to employ a thermal head having heat generating elements close to the end of the head substrate board, thereby reducing the time from heat application to the peeling of the ink sheet and the recording sheet, as referred to "peeling" hereinafter.

The above-explained process enables image recording of high quality on a rough sheet, but, in the case of recording on a smooth sheet, the ink sheet has to be given a larger tension than in the case of rough sheet, in order to attain complete peeling of the ink sheet and the recording sheet. A tension same as in the case of rough sheet may result in defective ink transfer due to incomplete peeling. In order to solve this problem, it has been thought to apply a high tension at the ink transfer, thereby achieving complete peeling from rough to smooth paper, but, in such case, a stronger mechanism is required because the ink sheet is always under a high tension.

SUMMARY OF THE INVENTION

An object of the present invention is to provide an image recording apparatus capable of sharp image recording.

Another object of the present invention is to provide an image recording apparatus capable of providing sharp image recording even on a recording medium of low surface smoothness.

Still another object of the present invention is to provide an image recording apparatus capable of sharp ink transfer and image recording with high quality and high image density on any recording medium with high or low surface smoothness.

Still another object of the present invention is to provide an image recording apparatus capable of automatically detecting the surface smoothness of the recording medium and achieving image recording with a peeling angle (for peeling the ink sheet from the recording medium) and an electric energy corresponding to thus detected surface smoothness.

Still another object of the present invention is to provide an image recording apparatus capable of easily varying the peeling angle and the electric energy supplied to the thermal head according to the employed recording medium, by renewably storing the optimum peeling angles and the electric energies in mutually corresponding manner and suitably selecting these stored values.

BRIEF DESCRIPTION OF THE DRAWINGS

FIG. 13 is a flow chart of printing sequence in the second embodiment.

DETAILED DESCRIPTION OF THE PREFERRED EMBODIMENTS

Now the present invention will be clarified in detail by preferred embodiments thereof shown in the attached drawings.

Before entering the embodiments of the present invention, there will at first be explained the results of experiments on the surface smoothness of a recording medium (paper in this case) and the image transfer performance thereof, under a constant tension of the ink sheet. The results are summarized in Table 1.

As will be apparent from Table 1, in the recording on a smooth paper, satisfactory recording can be obtained with smaller energy and a larger peeling angle. On the other hand, on a rough paper, satisfactory recording can be achieved with larger energy and a smaller peeling angle. In general, the tension of the ink sheet at peeling should be larger when the peeling angle is small, and can be made smaller as the peeling angle becomes larger.

TABLE I

| | | | Smooth paper | Rough paper |
|---|---|---|---|---|
| Print quality | Applied thermal energy | Large | Collapse | Good |
| | | Small | Good | Print break |
| | Peeling angle | Large | Good | Print not sharp |
| | | Small | Print break (incomplete peeling due to insufficient tension) | Good |

Based on such results, it is possible to obtain satisfactory printing on any recording medium, by applying a constant tension to the ink sheet (thermal transfer material), and applying smaller energy and a larger peeling angle for a smooth paper and larger energy and a smaller peeling angle for a rough paper. In the following there will be explained embodiments based on such experimental results.

Figure 1:
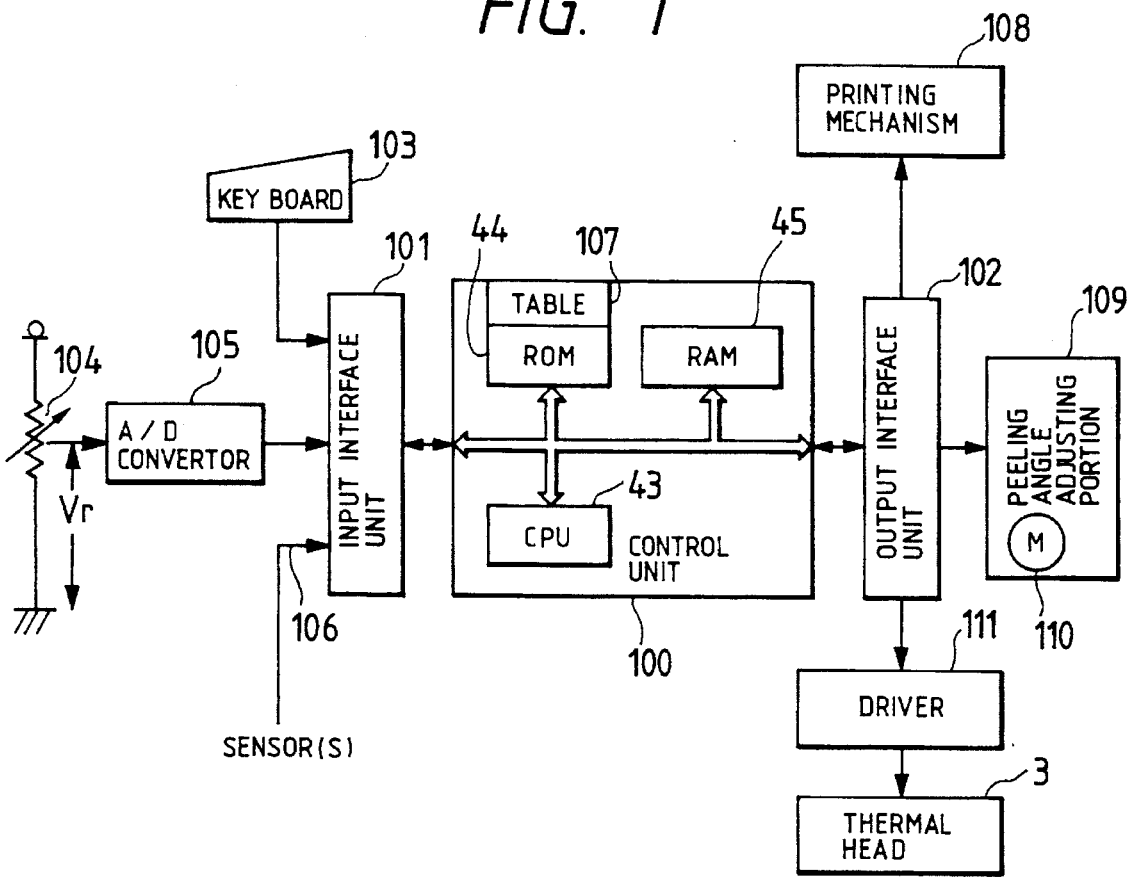
FIG. 1 is a block diagram of an electronic typewriter constituting a first embodiment of the present invention.

Electronic typewriter (FIG. 1, Table I)

FIG. 1 is a schematic block diagram of an electronic typewriter constituting an embodiment of the present invention.

Figure 7:
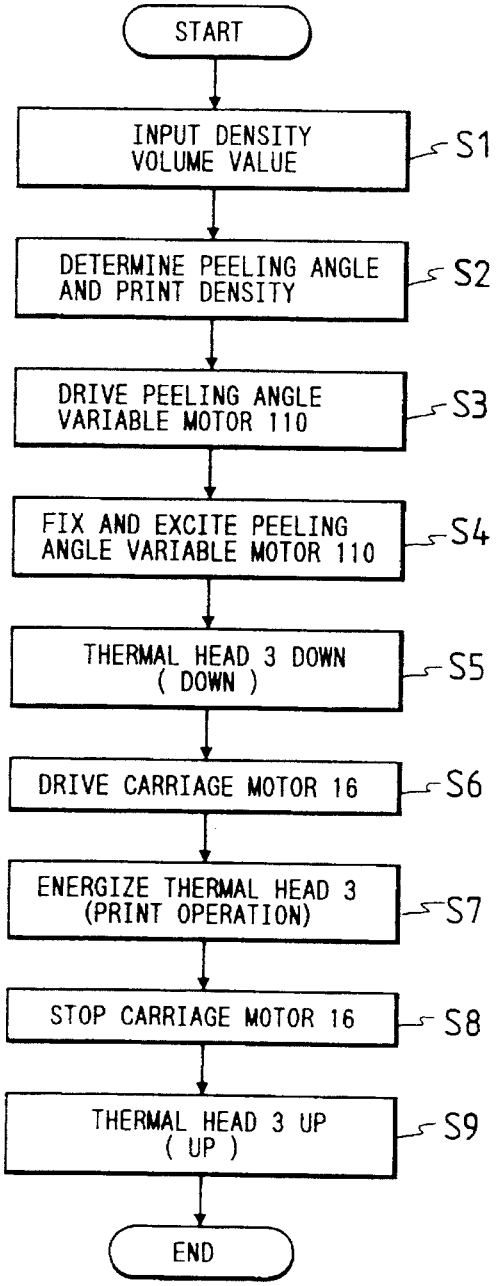
FIG. 7 is a flow chart showing a printing sequence of the first embodiment.

A control unit 100 for controlling the entire apparatus is provided with a CPU 43, composed for example of a microprocessor, which releases various control signals, processes the input signals from an input interface 101 and sends signals to an output interface 102 for controlling various functions, according to a control program stored in a ROM 44, as shown by a flow chart in FIG. 7. A RAM 45 is used as a work area of the CPU 43, and temporarily stores, for example, the set value of a variable resistor 104.

An input interface 101 receives signals from a keyboard 103, various sensors and an A/D converter 105, for supply to the control unit 100. An output interface 102 sends print data from the control unit 100 and various control signals to a print mechanism 108, and sends control signals to a peeling angle regulator 109, to be explained later. Thus the control unit 100 can effect serial recording by driving the print mechanism 108.

Figure 2:
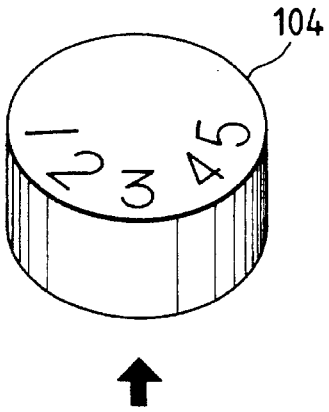
FIG. 2 is an external view of a variable resistor.

A keyboard 103 is used for entering text information and various commands. The codes entered from the keyboard 103 are supplied, through the input interface 101, to the control unit 100. Character codes from the keyboard 103 are stored in the RAM 45, and are developed into patterns, based on the pattern data stored in the ROM 44, the data of said patterns being supplied to a thermal head 3 for printing. A density controlling variable resistor 104, illustrated in FIG. 2, is used by the operator for controlling the print density, for example according to the kind of the recording sheet to be used in printing.

An A/D converter 105 receives the voltage Vr set by the density control variable resistor 104 and converts it into a digital signal to output it. Input signals 106 are received from sensors, for detecting the recording sheet in the print mechanism 108 or for detecting the temperature of the thermal head 3. The CPU 43 stores the output of the A/D converter 105, received through the input interface 101 in the RAM 45 and determines set value of the peeling angle or set value of the density volume 104, namely the energizing period of a motor 110, and the energy (voltage or energizing period) supplied to the heat-generating resistor of the thermal head 3, based on the value stored in RAM 45 and on a table 107 in the ROM 44. Based on these values, the CPU 43 applies control signals to a driver 111 for the thermal head and the peeling angle regulator 109 through the output interface 102, thereby regulating the recording density.

Figure 4:
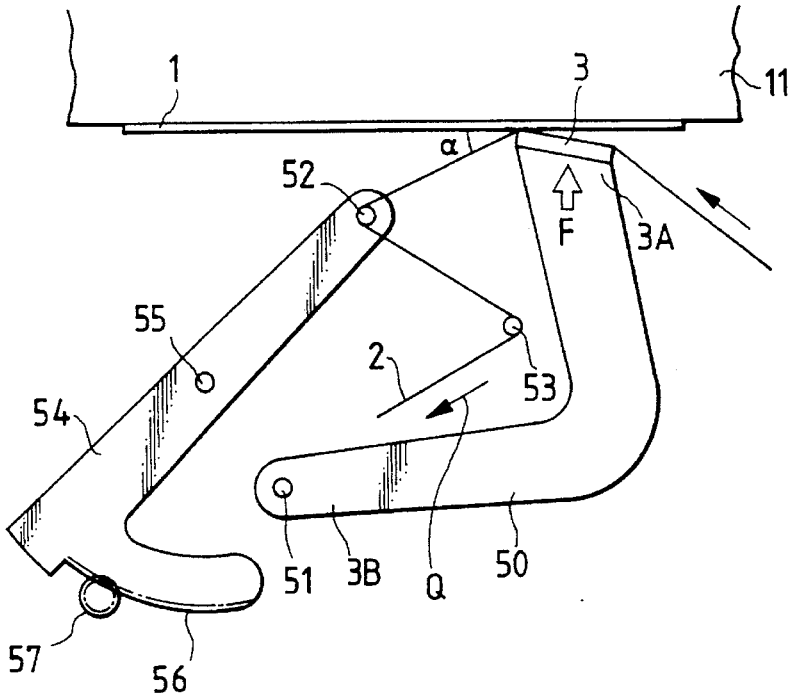
FIGS. 4 and 5 are schematic views of a peeling angle regulating unit.
Figure 5:
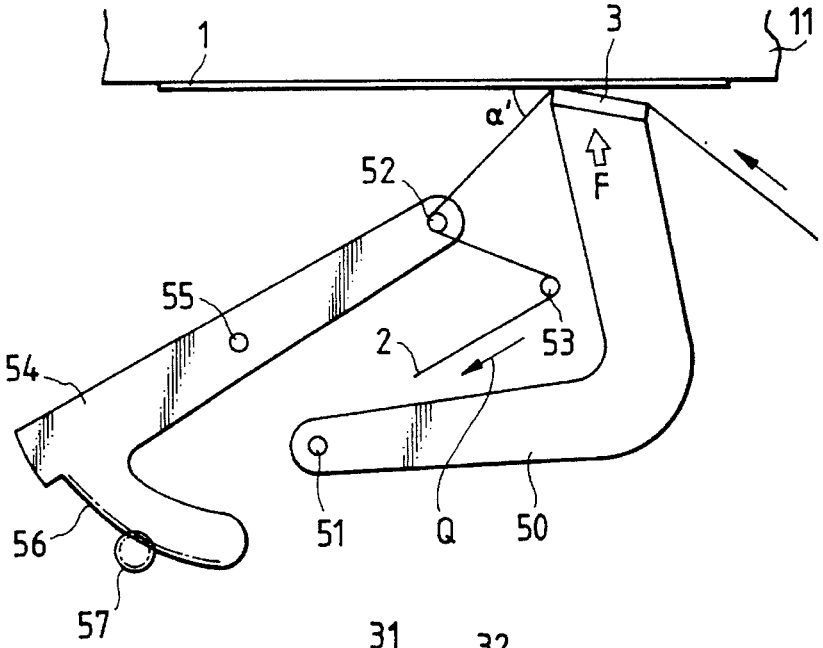

A peeling angle regulator 109, of which details are shown in FIGS. 4 and 5, regulates the angle of the thermal head 3 (angle of ink sheet 2 when peeled from the recording sheet 1), by energizing the motor 110 according to the instruction from the control unit 100. A driver 111 for the thermal head 3 drives the thermal head with a voltage or an energizing period instructed by the control unit 100, based on the print data supplied from the output interface 102. A print mechanism 108 contains a mechanism for feeding the recording sheet, and a carriage driving mechanism for causing the scanning motion of the serial thermal head.

Image recording unit (FIG. 3)

Figure 3A:
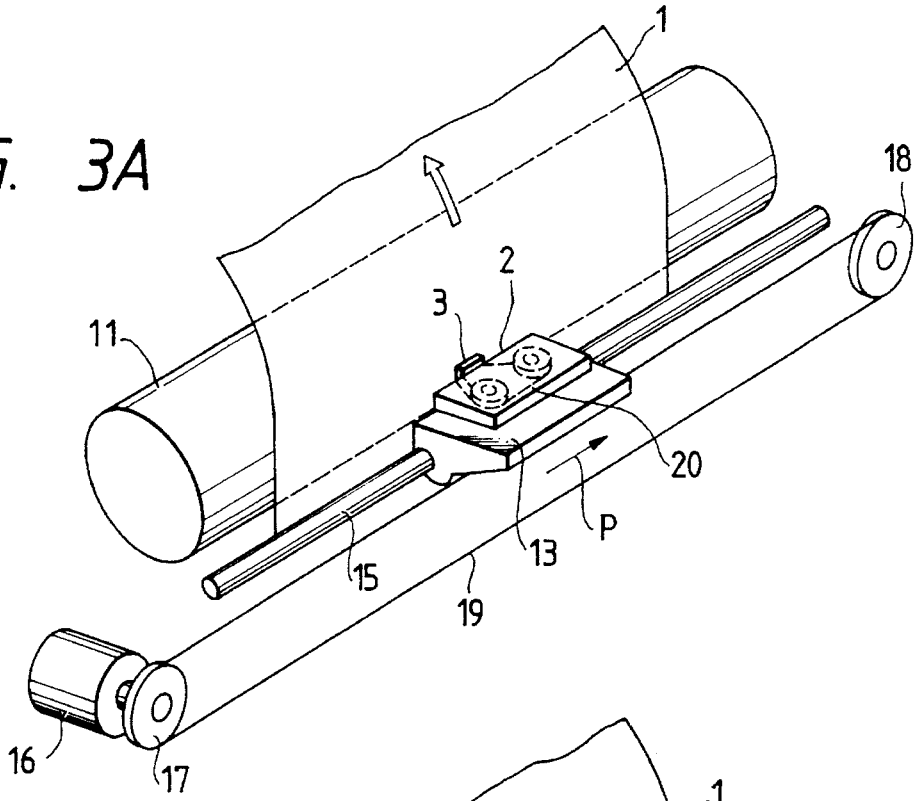
FIGS. 3A and 3B are external perspective views of a printing part of a printing mechanism.

FIG. 3A is a perspective view of the print unit, employing serial thermal transfer method, of the print mechanism of the present embodiment.

The recording is achieved by the thermal head 3 mounted on a carriage 13, onto the recording sheet 1 supported by a platen 11. Said platen 11 formed as a roller and services also as a sheet transporting roller. The carriage 13 is slidably mounted on a guide shaft provided parallel to the platen 11, and is reciprocated by a driving system consisting of a stepping motor 16, a driving pulley 17, an idler pulley 18 and a belt 19 supported by said pulleys and connected to the carriage 13.

The thermal head 3 is provided with plural heat-generating elements, for example 32 heat-generating resistors arranged in a vertical line, and is mounted movable between a down position in contact with the recording sheet 1 and an up position separation from the recording sheet 1.

On the carriage 13, there is mounted a ribbon cassette 20 for feeding an ink ribbon 2 in front of the thermal head 3, namely between said thermal head and the recording head 1. The ink ribbon 2 in the ribbon cassette 20 is wound in a predetermined direction by a ribbon driving shaft (not shown) provided on the carriage 13, in synchronization with the scanning motion of the thermal head 3 and the carriage 13.

The ink ribbon 2 preferably utilizes, for example, thermal transfer ink principally composed of ethylene-vinyl acetate copolymer for printing on a rough paper. As shown in FIG. 3C, said ink ribbon 2 is composed of a substrate 2*a* consisting of a polyethylene terephthalate film of a thickness of 6 μm, and three thermal transfer ink layers 2*b*, 2*c*, 2*d* of following compositions laminated thereon. Said thermal transfer ink layers, when transferred onto the recording sheet 1, forms a film-formed image in the recording sheet 1.

Table II shows the compositions of said layers 2*b*–2*d*, in which per cent and parts are represented in weight.

In the above-explained structure, the thermal head 3 is pressed against the recording sheet 1 across the ink ribbon 2 at the image recording, and the carriage 13 is moved in the main scanning direction P with the winding of the ink ribbon 2. During such movement, the recording is achieved by driving the dot forming means of the thermal head 3 moving together with the carriage 13, through the driver 111 according to the print data signal.

TABLE II

| | | |
|---|---|---|
| 1st layer (1 μm) 2b in FIG. 3C | | polyethylene oxide emulsion (base resin drip point 103° C.) |
| 2nd layer (2 μm) 2c in FIG. 3C | 40 parts | ethylene-vinyl acetate copolymer emulsion (base resin M115 with vinyl acetate content 28%) |
| | 20 parts | polyethylene oxide emulsion (base resin drip point 140° C.) |
| | 10 parts | vinyl acetate-ethylene copolymer emulsion (base resin with vinyl acetate content 86%) |
| | 30 parts | carbon black aqueous dispersion |
| 3rd layer (2 μm) 2d in FIG. 3C | 40 parts | ethylene-vinyl acetate copolymer emulsion (base resin M115 with vinyl acetate content 28%) |
| | 30 parts | ethylene-methacrylic acid-styrene copolymer emulsion |
| | 20 parts | vinyl acetate-ethylene copolymer emulsion (base resin with vinyl acetate content 80%) |
| | 10 parts | carbon black aqueous dispersion |

Figure 3B:
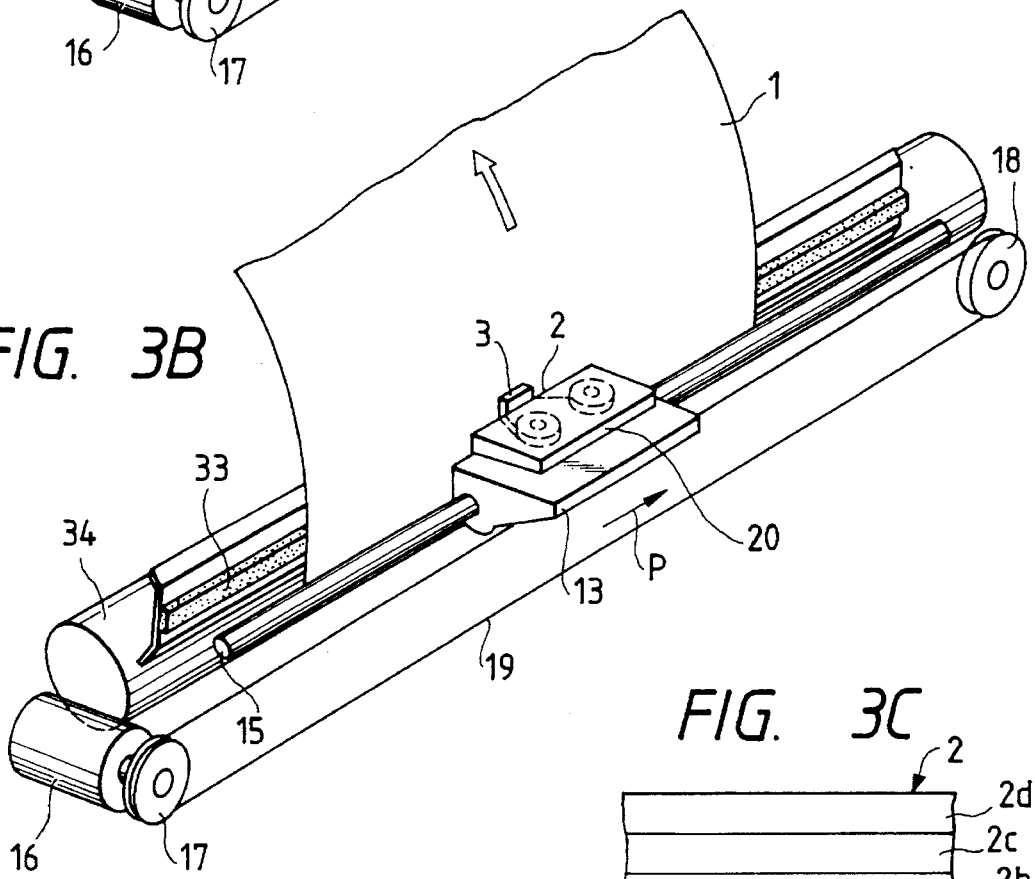
Figure 3C:
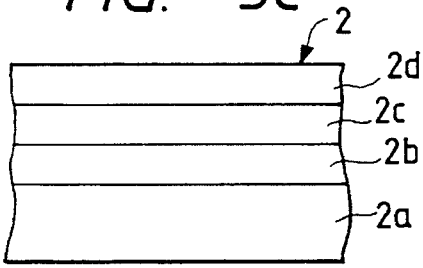
FIG. 3C is a cross-sectional view of an ink sheet.

FIG. 3B is a perspective view of a printing unit of serial thermal transfer type constituting another embodiment, wherein the same components as those in FIG. 3A are represented by same numbers, and will not be explained further.

In FIG. 3B, recording is achieved with the thermal head 3 mounted on the carriage 13, onto the recording sheet 1 supported by a flat platen 33. For advancing the recording sheet 1, there is provided a sheet transporting roller 34. The carriage 13 moves along the guide shaft 15 provided parallel to the flat platen 33.

Peeling angle regulating unit (FIGS. 4 and 5)

FIG. 4 is a plan view of a peeling angle regulator 109, in which same components as those in FIGS. 3A to 3C are represented by same numbers.

Referring to FIG. 4, a J-shaped head arm 50 supports the thermal head 3 at an end 3A, and is rotatably supported, at the opposite end 3B, by a shaft 51 fixed on the carriage 13. The head arm 50 is provided with an unrepresented mechanism for regulating the print pressure, for pressing the head 3 with a predetermined force F. Shafts 52, 53 are provided for guiding the ink ribbon 2, which is advanced in a direction Q. The shaft 52 is mounted on a peeling angle setting arm 54 and is capable, by the rotation of the arm 54, of varying the peeling angle with which the ink ribbon 2 is peeled off from the recording sheet 1. On the other hand, the shaft 53 is fixed on the carriage 13.

The peeling angle setting arm 54 is rotatably supported by a shaft 55 fixed on the carriage 13, and is provided, on an end opposite to the shaft 52, with an arc-shaped rack 56 meshing with a pinion 57 rotated by the motor 110 as shown in FIG. 1.

When the pinion 57 is rotated clockwise by the motor 110 while the thermal head 3 is shifted up ward, the peeling angle setting arm 54 is rotated counterclockwise, thus setting the peeling angle α smaller. On the other hand, when the pinion 57 is rotated counterclockwise, the arm 54 is rotated clockwise thus setting the peeling angle α larger.

At the start of power supply, said peeling angle α is set at the minimum value, and the motor 110 is rotated until a desired peeling angle α is obtained. Then the coils of the motor 110 are fixedly energized, so that the arm 54 remains in the current position, thereby maintaining a constant peeling angle.

FIG. 5 shows a state of a larger peeling angle than in the case of FIG. 4.

After the setting of the peeling angle at a desired value in this manner, the head arm 50 is rotated counter-clockwise about the shaft 50 by the unrepresented print pressure regulating mechanism, whereby the thermal head 3 is pressed with a pressing force F against the platen 11. The image recording can be achieved in this state, by taking up the ink ribbon 2 with the unrepresented ribbon motor and activating the thermal head 3.

As explained above, the peeling angle α of the ink ribbon 2 can be arbitrarily selected by the amount of rotation of the pinion 57 or of the motor 110.

Figure 6:
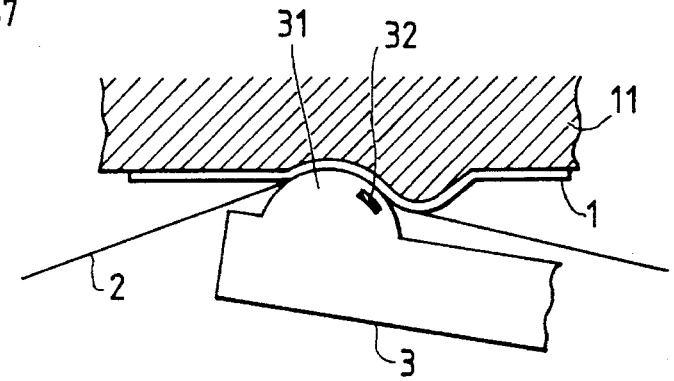
FIG. 6 is an enlarged view of a heat generating portion of a thermal head.

Heat-generating portion of thermal head (FIG. 6)

FIG. 6 is an enlarged view of the heat generating portion of the thermal head 3, wherein shown are a glazed layer 31 of the thermal head 3, and plural heat-generating resistors 32 for generating heat upon receiving electric current. The ink ribbon 2 is heated by said thermal head 3, and the ink is fused in a position corresponding to energized heat-generating resistor and is transferred onto the recording sheet 1. The image density can be regulated by varying the voltage supplied to the resistor 32 or the period of electric power supply thereto.

Description of function (FIG. 7)

FIG. 7 is a flow chart of the printing operation in the electronic typewriter of the foregoing embodiments, and said operation is initiated by a print command entered from the keyboard 103.

When a printing operation of a character or a line is instructed by the keys of the keyboard 103, a step S1 stores the set value of the density regulating variable resistor 104 supplied from the A/D converter 105 (digital value corresponding to voltage Vr) in the RAM 45. Then a step S2 determines the driving time of the motor 110 of the peeling angle regulator 109 and the driving voltage of the thermal head 3 by the driver 111, based on the digital value stored in the RAM 45 and utilizing the table 107 in the ROM 44.

Table III shows an example of the energy applied to the heat-generating resistor and the peeling angle as a function of the smoothness of the recording sheet. The sheet becomes smoother as the number in seconds increases.

TABLE III

| Smoothness of recording sheet 1 (sec) | Energy applied ($mJ/mm^2$) | Peeling angle ($\alpha$) |
|---|---|---|
| 200 | 10 | 60° |
| 54 | 14 | 40° |
| 10 | 20 | 25° |

The table 107 of the ROM 44 stores the energies or voltages supplied to the resistor 32 and the peeling angle $\alpha$ of the ink ribbon 2 in relation to the output values of the A/D converter 105, as shown in Table III. Consequently the CPU 43 reads the peeling angle and the voltage to be supplied to the thermal head 3 from the table 107, based on the digital value of the A/D converter 105 stored in the RAM 45, and sends corresponding control signals to the peeling angle regulator 109 and the driver 111, thereby regulating the image density.

A step S3 activates the motor 110 through the output interface 102 for a period (or a number of rotations) determined in the step S2. Then a step S4 fixedly energizes the motor 110 to complete the regulation of the peeling angle. A step S5 shifts the thermal head 3 downwards to press it against the recording sheet 1 with a desired pressure. A step S6 starts the rotation of the carriage motor 16, and a step S7 supplies the driver 111 with print data to activate the thermal head 3, thereby effecting the printing on the recording sheet 1. In this operation, the driver 111 varies the print density by controlling the current supply to the thermal head 3, based on the value of voltage or driving period supplied from the control unit 100 together with the print data.

After the printing of a character or a line, the sequence proceeds to a step S8 to terminate the rotation of the carriage motor 16. Then a step S9 shifts the thermal head 3 upwards from the platen 11 to terminate the recording operation.

If the motor 110 is composed of a stepping motor, the step S3 activates the motor for a predetermined number of steps to regulate the peeling angle.

As explained in the foregoing, this embodiment allows a single variable resistor to regulate the peeling angle and the energy supplied to the heat-generating elements 32 of the thermal head 3 in mutually linked manner, so that the operator can obtain optimum recording with a single operation corresponding for example to the change in the recording sheet.

Figure 10:
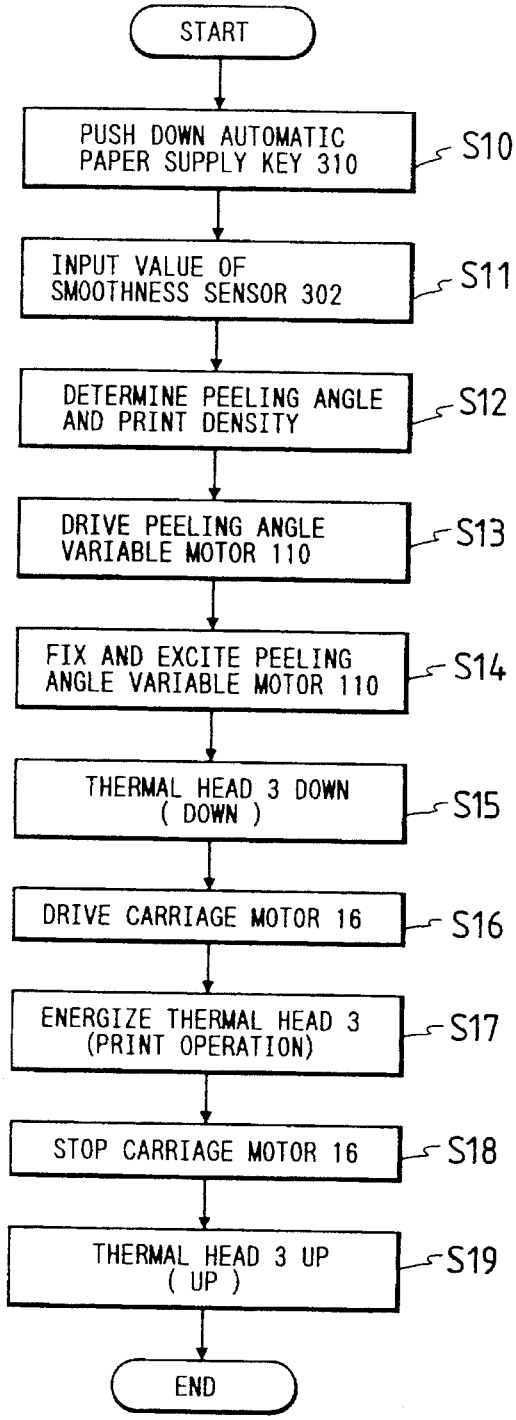
FIG. 10 is a flow chart showing printing sequence in the electronic typewriter of the second embodiment.
Figure 8:
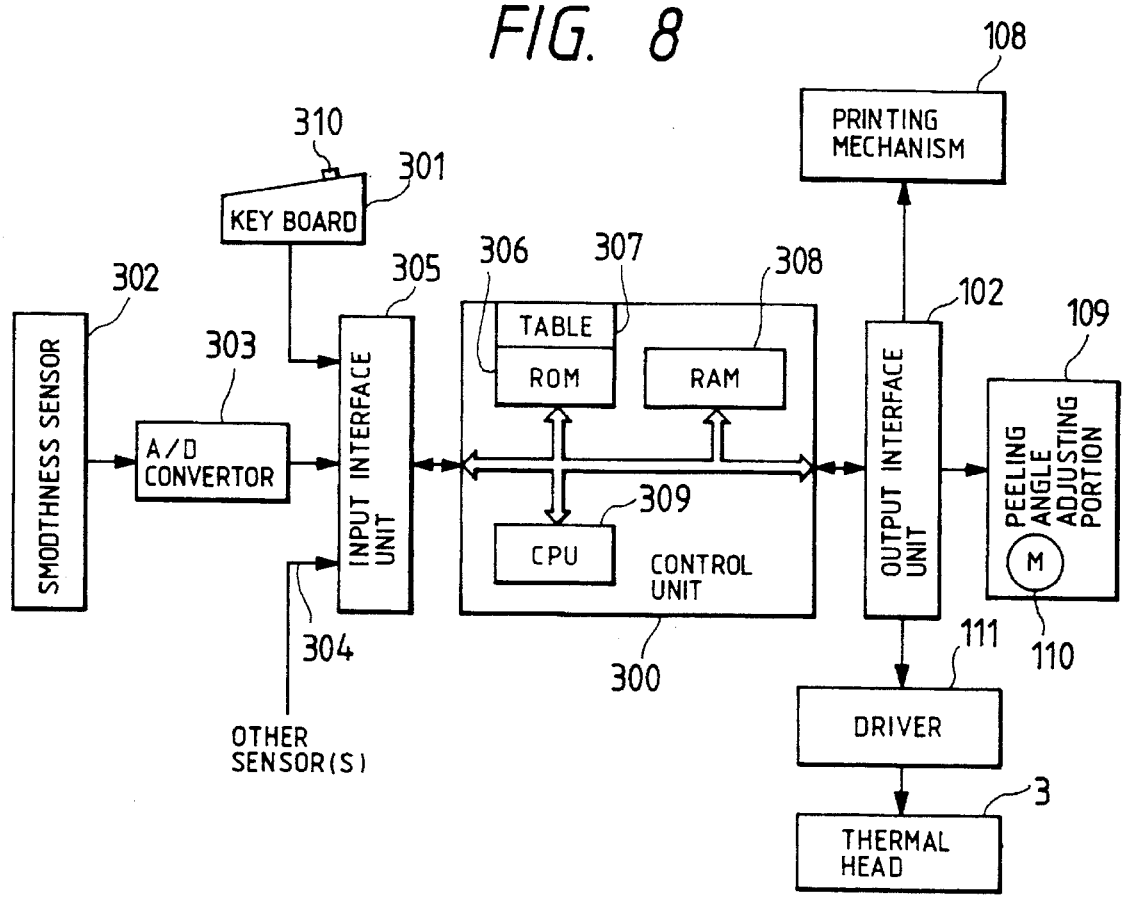
FIG. 8 is a block diagram of an electronic typewriter constituting a second embodiment.
Figure 9:
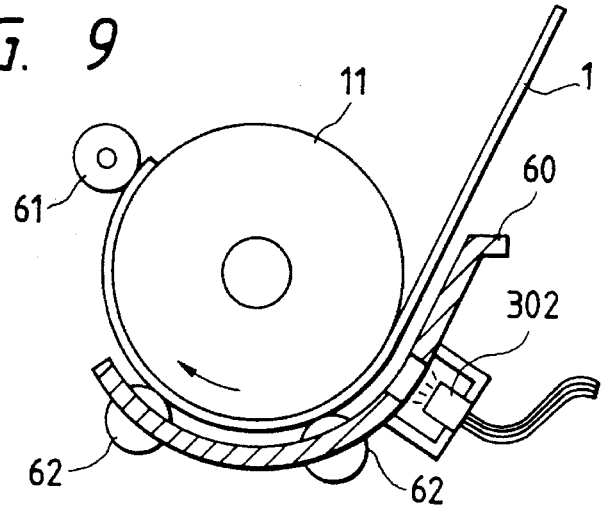
FIG. 9 is a schematic view showing the position of a smoothness sensor.

Second embodiment (FIGS. 8 to 10)

FIG. 8 is a schematic block diagram of an electronic typewriter constituting a second embodiment of the present invention, in which same components as those in the first embodiment are represented by same numbers. FIG. 9 is a cross-sectional view showing the mounting of a smoothness sensor for detecting the smoothness of the recording sheet 1.

In FIG. 9, there are shown a paper guide 60 for guiding the recording sheet 1, paper feeding rollers 62 for winding the recording sheet 11 on a platen roller 11 and maintaining said sheet on said roller, and a sheet discharging roller 61. A smoothness sensor 302 for measuring the smoothness of the recording sheet 1 illuminates said sheet with light, and, based on the intensity of the reflected light, generates a voltage signal corresponding to the smoothness of the recording surface of the sheet 1. The output voltage of the sensor 302 is converted by an A/D converter 303 into a digital signal, which is stored through an input interface 305 into a RAM 308 under the control of a CPU 309.

Figures 12A, 12B, 12C, 12D:
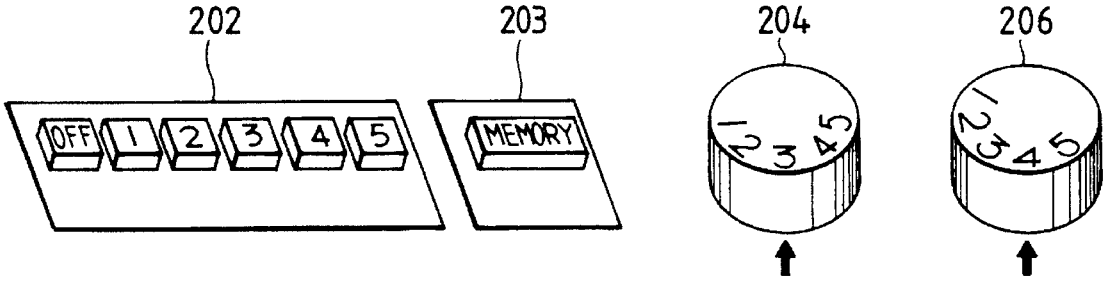
FIGS. 12A to 12D are external views of learning function keys, a peeling angle regulating variable resistor, and an electric energy regulating variable resistor.

The CPU 309 stores, in the RAM 308, the input signals from the keyboard 301, A/D converter 303 etc. and sends control signals to the peeling angle regulator 109, driver 111 etc. through the output interface 102, based on the above-mentioned input signals and the data already stored in the ROM 306, according to a program stored in the ROM 306, as shown by a flow chart in FIG. 12. The CPU 309 also effects various control operation for driving the print mechanism 108 for effecting the serial recording operation.

In the following there will be further explained the recording density control on the recording sheet 1 and the regulation of the peeling angle with which the ink ribbon 2 is peeled off from the sheet 1. Based on the data for the peeling angle and the energy for the heat-generating elements stored in the RAM 308, the CPU 309 determines the energizing period of the motor 110 and the voltage to be supplied to the heat-generating elements 32 of the thermal head 3 with reference to a table 307, and sends control signals to the peeling angle regulator 109 and the driver 111 through the output interface 102.

According to the control signal from the output interface 102, the peeling angle regulator 109 energizes the motor 110 for the instructed period, for example at the automatic paper feeding, to rotate the pinion 57 accordingly, thereby regulating the peeling angle. At the recording operation, the driver 111 energizes the heat-generating elements 32 of the thermal head 3 thereby executing the printing operation.

The above-mentioned smoothness sensor 302 is used for controlling the peeling angle and the energy for the heat-generating elements 32 by selecting the values from a table 307 of the ROM 306 in such a manner that, as shown in Table II, the peeling angle decreases and the voltage to the heat-generating resistors 32 increases for a rougher recording sheet 1, and vice versa.

In response to the actuation of an auto sheet feeding key 310 of the keyboard 301 in a step S10, the recording sheet 1 is set at the printing position shown in FIG. 9. In a step S11, the smoothness sensor 302 measures the smoothness of the recording sheet 1 and stores it as an input value. A step S12 determines the peeling angle and the image density, based on said input value and utilizing the table 307.

Steps S13 and S14 activates the motor 110 by an amount corresponding to said peeling angle, terminates the activation of the motor at the predetermined peeling angle and fixes the motor by magnetization. A step S15 shifts the thermal head 3 downwards to bring it into contact with the recording sheet 1, and a step S16 initiates the drive of the carriage motor 16. Then a step S17 provides the driver 111 with the print data and the driving voltage (or driving time) of the thermal head 3 determined in the step S3, thereby driving the thermal head 3 and effecting the printing operation.

After the printing, operation of a character or a line in this manner, the sequence proceeds to a step S18 to terminate the rotation of the motor 110. Then a step S19 lifts the thermal head 3 from the recording sheet 1 to terminate the printing operation.

As explained in the foregoing, this second embodiment automatically detects the smoothness of the recording surface of the recording sheet 1 and accordingly regulates the peeling angle and the electric energy to be supplied to the heat-generating elements 32 of the thermal head 3, so that optimum recording can be obtained regardless of the quality of the recording sheet 1.

Figure 11:
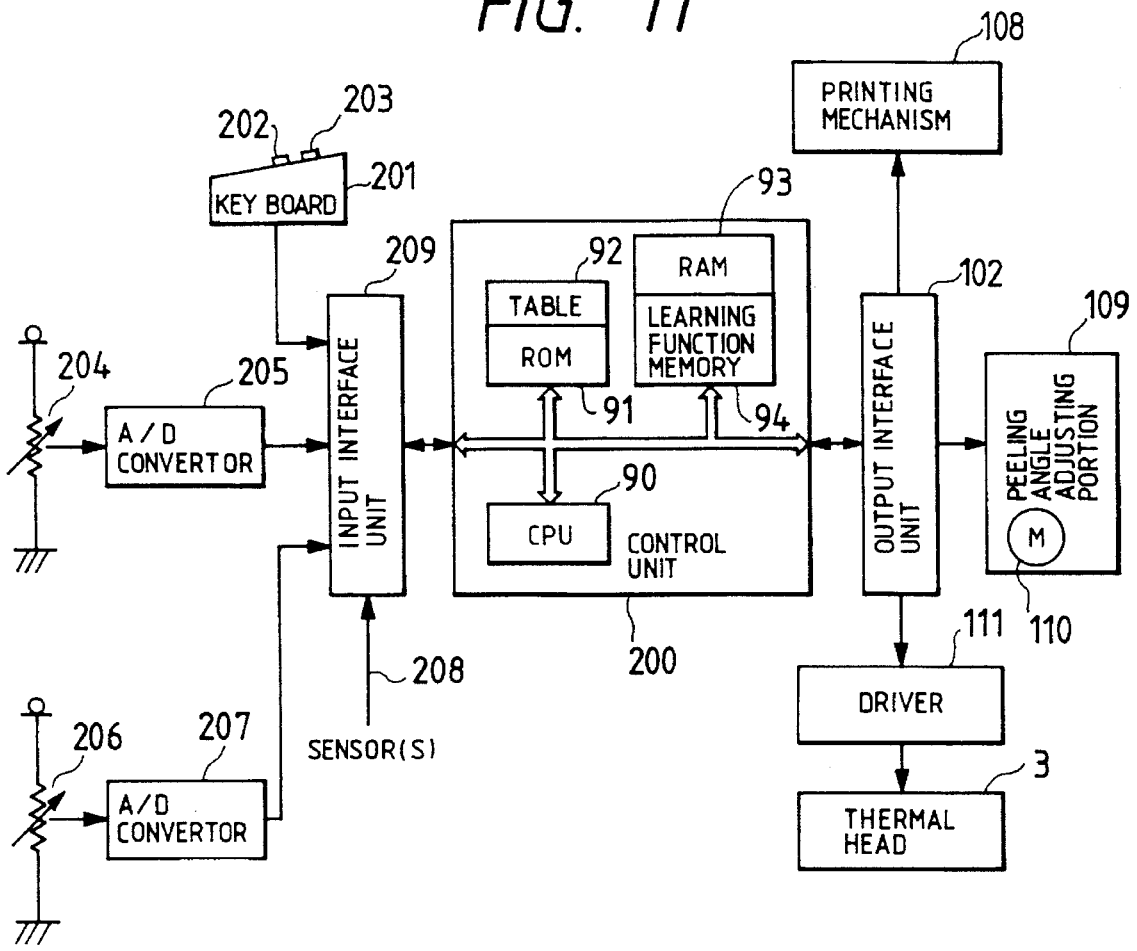
FIG. 11 is a block diagram of an electronic typewriter constituting a third embodiment.

3rd embodiment (FIGS. 11 to 13)

FIG. 11 is a schematic block diagram of an electronic typewriter constituting a third embodiment, in which same components as those in the first and second embodiments are represented by same numbers. FIGS. 12A to 12D are external views respectively of function learning switches 202, 203, and variable resistors 204, 206 of a keyboard 201.

The variable resistors 204, 206 are used respectively for setting a peeling angle corresponding to the quality of the recording sheet 1, and an electric energy to be supplied to the thermal head 3. The output voltages of said variable resistors are converted into digital values respectively by A/D converters 205, 207, of which outputs are fetched in a RAM 93 through an input interface 209, under the control of a CPU 209.

There are provided five learning function keys 202 corresponding to five sets of learnt data, which can be turned off by an off key, and a learning function memory key 203.

The keyboard 201 is provided, as shown in FIG. 11, with learning function keys 202 for density control with the learnt data, and a learning function memory key 203 for memorizing the learnt data. A table 92 of the ROM 91 stores the peeling angle (or the energizing period of the number of steps of the motor 110) corresponding to the setting of the variable resistor 204, and the voltage or energizing period for the thermal head 3 corresponding to the setting of the variable resistor 206.

A learning function memory 94 stores fives sets of the peelings angles and the applied voltages or energizing periods, respectively corresponding to the above-mentioned learning function keys 202, so that the actuation of one of said keys selects a set of the peeling angle and the energy applied. If the memory key 203 is turned on, the digital values of the voltages set by the variable resistors 204, 206 are stored in an area of the learning function memory 93, indicated by the learning function key 202.

The CPU 90 stores, in the RAM 93, the input signals from the keyboard 201 and the A/D converter 207 etc. and sends control signals to the peeling angle regulator 109, driver 111 etc. through the output interface 102, based on the above-mentioned input signals and the data already stored in the ROM 92, according to a program stored in said ROM 306, as shown by a flow chart shown in FIG. 13. The CPU 90 also effects various control operations for driving the print mechanism 108 for effecting the serial recording operation.

In the following there will be further explained the recording density control on the recording sheet 1. Based on the data for the peeling angle (setting of the variable resistor 204) and the energy for the heat-generating elements (setting of the variable resistor 206) stored in the RAM 93, the CPU 90 determines the energizing period of the motor and the voltage to be supplied to the heat-generating elements 32 of the thermal head 3 with reference to a table 92, and sends control signals to the peeling angle regulator 109 and the driver 111 through the output interface 102.

According to the control signal from the output interface 102, the peeling angle regulator 109 energizes the motor 110 for the instructed period, for example at the start of recording operation, to rotate the pinion 57 accordingly, thereby regulating the peeling angle. Also the driver 111 energizes the heat-generating elements 32 of the thermal head 3 thereby executing the printing operation.

The above-mentioned variable resistors 204, 206 are used for achieving optimum image recording, by selecting a smaller peeling angle and a higher voltage for the heat-generating resistors 32 for a rougher recording sheet 1, or a larger peeling angle and a lower voltage for the heat-generating resistors 32 for a smoother recording sheet 1.

When image recording is instructed from the keyboard 201, a step S20 discriminates whether the learning function memory switch 203 is turned on. If it is on, indicating an instruction for memorizing the learning function, the sequence proceeds to a step S22 for entering the settings of the variable resistors 204, 206.

If said switch 203 is off, the sequence proceeds to a step S21 for discriminating whether any of the learning function switches 202 is turned on. If none of said switches is on, the sequence proceeds to a step S22 for entering the setting of the variable resistor 204 indicating the peeling angle, and determining the peeling angle from the table 92. A next step S23 enters the setting of the density regulating variable resistor 206, for setting the voltage to be supplied to the thermal head 3, and determines the voltage to be supplied to the thermal head 3 from the driver 111, with reference to the table 92.

On the other hand, if the step S21 identifies that any of the learning function switches 202 is turned on, the sequence proceeds to a step S24 for reading data, indicating the peeling angle and the driving voltage for the thermal head 3, from an area of the learning function memory 94, corresponding to the actuated switch. Said data are digital values released form the A/D converters 205, 207, respectively corresponding to the setting of the afore-mentioned variable resistors.

Then a step S25 drives the motor 110 of the peeling angle regulator 109, according to the peeling angle data determined in the step S22 or S24, thereby regulating the peeling angle. Then a step S26 shifts the thermal head 3 downwards, thereby bringing it in contact with the recording sheet 1. A step S27 initiates the driving of the carriage motor 16, and a step S28 provides the driver 111 with the print data and the driving voltage (or energizing period) of the thermal head 3 set in the step S24 or S23, thereby activating that thermal head 3 and executing the printing operation.

After the printing of a character or a line in this manner, the sequence proceeds to a step S29 for terminating the drive of the carriage motor 16. Then a step S30 lifts the thermal head 3 from the recording sheet 1.

If the step S31 identifies that the learning function memory switch 203 has been turned on, the sequence proceeds to a step S32 which discriminates whether any of the settings of the variable resistors 204, 206 is to be varied, by comparing the original setting stored in the RAM 93 with the digital value entered form the A/D converter 205 or 207. If an image recording is instructed in the step S33 before the setting of the variable resistor 204 or 206 is changed, the sequence proceeds to the step S20 for executing the printing operation.

If the step S32 identifies a change in the setting of the variable resistor 204 or 206, a step S34 discriminates whether any of the learning function keys 202 has been actuated. If none of said keys 202 has been actuated, the sequence proceeds to the step S31 without the renewal of the learnt data. On the other hand, if the step S34 identifies that a number of learning functions has been designated by said keys 202, the sequence proceeds to a step S35 to renew the data of the learning function memory 94 corresponding to said number designated by the keys 202, for example by storing the digital value from the A/D converter 205 or 207 in a corresponding area of the learning function memory 94.

Then a step S36 discriminates whether the printing operation has been completed, and, if not completed, the sequence returns to the step S20 to repeat the above-explained sequence.

In this manner the data of the learning function memory 94 are renewed in an area corresponding to the number designated by the learning function key 202, and it becomes thereafter possible to select the optimum peeling angle and head driving energy by designating a number with the learning function keys 202 corresponding to the specy of the recording sheet 1.

In the RAM 93, at least the learning function memory 94 may be constructed non-volatile in order to prevent the loss of the data when the power supply of the apparatus is cut off.

In the present embodiment, the data stored in the learning function memory 94 are the digital output values of the A/D converters, but such form is not limitative. For example it is also possible to store the peeling angle and the voltage (or energizing period) determined from said digital values.

As explained in the foregoing, the present embodiment allows the users to vary the peeling angle and the heat driving energy in mutually related manner with a single selector switch, so that the operator can select optimum image recording with a single operation, according to the kind of the recording sheet to be used.

Also the present embodiment enables easy adjustment of the peeling angle and the head driving energy, since there are respectively provided variable resistors for regulating the peeling angle and the head driving voltage, of which settings can be stored and retrieved according to the change in the kind of the recording sheet.

Furthermore, as these stored settings can be renewed by the settings of said variable resistors, there can be stored optimum values corresponding for example to the kind of the recording sheet.

The foregoing first, second and third embodiments have been explained by serial thermal transfer recording apparatus, but the present invention is not limited to such embodiments and is likewise applicable to different types of thermal head, such as the line print type.

As explained in the foregoing, an embodiment of the present invention allows to regulate both the peeling angle, with which the ink sheet is peeled off from the recording medium, and the energy supplied to the thermal head by means of single density regulating means, so that stable recording can always be obtained even when the recording sheet is changed.

Another embodiment automatically detects the smoothness of the recording surface of the recording medium and accordingly regulates the peeling angle and the electric energy supplied to the thermal head, so that optimum recording can always be obtained even when the recording sheet is changed.

Still another embodiment can regulate the peeling angle and the energy supplied to the thermal head and can further store these values in relation to the kind of the recording sheet or medium and read out these values in arbitrary manner, so that the regulation of the peeling angle and the head driving energy can be easily achieved.

Thus, the present invention, being capable of image recording adapted to the recording medium, can provide sharp recorded images.

What is claimed is:

1. An image recording apparatus for recording an image by transferring an ink from a heat-sensitive transfer material onto a recording medium according to image information, comprising:

regulating means for regulating an electric energy to be supplied to a recording head, said recording head having a downstream side relative to a conveyance direction of said ink sheet and a downstream edge disposed on said downstream side;

peeling angle regulator means for regulating a peeling angle at which said heat-sensitive transfer material is peeled off from said recording medium near said downstream edge, said peeling angle regulator means comprising a peeling angle setting arm rotatable about a shaft fixed on a carriage;

peeling angle designating means for designating an angle value of said peeling angle;

designating means for designating a density value of the image to be recorded on said recording medium;

memory means for storing a plurality of sets of angle values designated by said peeling angle designating means and density values designated by said designating means in a mutually related manner;

control means for reading one of said sets of the angle values and the density values from said memory means and controlling and thereby maintaining a predetermined relationship between said peeling angle regulator means and said regulating means according to the angle values and the density values of said one of said sets; and means for renewing a designated set of the angle values and the density values stored in said memory means, based on the angle designated by said peeling angle designating means and the density value designated by said designating means.

2. An apparatus according to claim 1, wherein said control means controls to decrease the electric energy and increase the peeling angle when a recording surface of the recording medium is smooth, and to increase the electric energy and decrease the peeling angle when said recording surface is rough.

3. An apparatus according to claim 1, wherein a density of the recorded image and said density value are set in accordance with a kind of recording medium used.

4. An image recording apparatus for recording an image by transferring an ink from a heat-sensitive transfer material onto a recording medium according to image information, comprising:

regulating means for regulating an electric energy to be supplied to a recording head, said recording head having a downstream side relative to a conveyance direction of said ink sheet and a downstream edge disposed on said downstream side;

peeling angle regulator means for regulating a peeling angle at which said heat-sensitive transfer material is peeled off from said recording medium near said downstream edge, said peeling angle regulator means varying the peeling angle while said recording head is in a retracted state;

peeling angle designating means for designating an angle value of said peeling angle;

designating means for designating a density value of the image to be recorded on said recording medium;

memory means for storing a plurality of sets of angle values designated by said peeling angle designating means and density values designated by said designating means in a mutually related manner;

control means for reading one of said sets of the angle values and the density values from said memory means and controlling and thereby maintaining a predetermined relationship between said peeling angle regulator means and said regulating means according to the angle values and the density values of said one of said sets; and means for renewing a designated set of the angle values and the density values stored in said memory means, based on the angle designated by said peeling angle designating means and the density value designated by said designating means.

5. An apparatus according to claim 4, wherein said control means controls to decrease the electric energy and increase the peeling angle when a recording surface of the recording medium is smooth, and to increase the electric energy and decrease the peeling angle when said recording surface is rough.

6. An apparatus according to claim 4, wherein a density of the recorded image and said density value are set in accordance with a kind of recording medium used.

7. A recording method for thermal transfer recording ink of an ink ribbon onto a recording sheet having a different surface smoothness using heat generated by a thermal head, said method comprising the steps of:

inputting information regarding a smoothness of a recording surface of the recording sheet;

pressing said thermal head against said recording sheet through the ink ribbon;

supplying to said thermal head an application energy corresponding to the smoothness of the recording surface inputted in said inputting step;

recording by transferring the ink of the ink ribbon onto the recording sheet using heat generated by said thermal head corresponding to said application energy; and peeling said ink ribbon from said recording sheet at a peeling angle corresponding to the smoothness of said recording surface inputted at said input step after recording in said recording step.

8. An method according to claim 7, wherein in said recording step the application energy is decreased when the recording surface is smooth and is increased when the recording surface is rough, and wherein in said peeling step the peeling angle is increased when the recording surface is smooth and is decreased when the recording surface is rough.

9. A method according to claim 7, further comprising a step of setting a density of an image recorded on the recording sheet in said recording step and a density value of the recorded image in accordance with a kind of recording sheet used.

10. An image recording apparatus for recording an image by transferring an ink from a heat-sensitive transfer material onto a recording medium according to image information, said apparatus comprising:

an electric power regulation section for regulating an electric power to be supplied to a recording head;

a peeling angle changing mechanism for changing a peeling angle at which said heat-sensitive transfer material is peeled off from said recording medium near said recording head and downstream therefrom with respect to a conveyance direction of said heat-sensitive transfer material when recording;

an input section for inputting surface roughness information regarding a roughness of a recording surface of said recording medium;

a memory section for storing electric power changing information regarding the electric power regulated by said electric power regulation section and peeling angle changing information regarding the peeling angle changed by said peeling angle changing mechanism to be selected in accordance with the surface roughness information inputted from said input section; and a control section for controlling the peeling angle changed by said peeling angle changing mechanism in accordance with the peeling angle changing information obtained from said memory section in response to the surface roughness information inputted from said input section and for controlling the electric power regulated by said electric power regulation section in accordance with the electric power changing information obtained from said memory section in response to the surface roughness information inputted from said input section.

11. An apparatus according to claim 10, wherein said control section controls to decrease the electric power and increase the peeling angle when the recording surface is smooth, and to increase the electric power and decrease the peeling angle when the recording surface is rough.

12. An apparatus according to claim 10, further comprising density controlling means for controlling a density of the recorded image and a density value so that said density and said density value are set in accordance with a kind of recording medium used.

13. An image recording apparatus for recording an image by transferring an ink from a heat-sensitive transfer material onto a recording medium according to image information, comprising:

regulating means for regulating an electric energy to be supplied to a recording head;

peeling angle regulator means for regulating a peeling angle at which said heat-sensitive transfer material is peeled off from said recording medium near said recording head and downstream therefrom with respect to a conveyance direction of said heat-sensitive transfer material when recording;

peeling angle designating means for designating an angle value of said peeling angle;

designating means for designating a density value of the image to be recorded on said recording medium;

memory means for storing a plurality of changing information of the peeling angle regulated by said peeling angle regulator means and changing information of the electric energy regulated by said regulating means;

control means for reading the changing information of the peeling angle and the changing information of the electric energy from said memory means and controlling and thereby maintaining a predetermined relationship between said peeling angle regulator means and said regulating means according to the changing information of the peeling angle and the changing information of the electric energy.

14. An apparatus according to claim 13, wherein said control means controls to decrease the electric energy and increase the peeling angle when a recording surface of said recording medium is smooth, and to increase the electric energy and decrease the peeling angle when the recording surface is rough.

15. An apparatus according to claim 13, wherein a density of the recorded image and said density value are set in accordance with a kind of recording medium used.

16. An image recording method, comprising the steps of:

recording an image by using a recording head to transfer an ink from a heat-sensitive transfer material onto a recording medium according to image information;

conveying said heat-sensitive transfer material in a conveyance direction;

peeling said heat-sensitive transfer material off from said recording medium near said recording head and downstream therefrom with respect to said conveyance direction when recording;

a first regulating step of regulating an electric energy to be supplied to said recording head;

a second regulating step of regulating a peeling angle at which said heat-sensitive transfer material is peeled off from said recording medium in said peeling step;

a first designating step of designating an angle value of said peeling angle;

a second designating step of designating a density value of the image to be recorded on said recording medium;

storing a plurality of changing information of the peeling angle regulated in said second regulating step and changing information of the electric energy regulated in said first regulating step;

reading the changing information of the peeling angle and the changing information of the electric energy stored in said storing step; and maintaining a predetermined relationship between said peeling angle and said electric energy according to the changing information of the peeling angle and the changing information of the electric energy.

17. An method according to claim 16, further comprising the steps of:

determining the roughness of a recording surface of said recording medium; and controlling the electric energy and the peeling angle so that the electric energy is decreased when the recording surface is smooth and is increased when the recording surface is rough, and so that the peeling angle is increased when the recording surface is smooth and is decreased when the recording surface is rough.

18. A method according to claim 16, wherein in said second designating step a density of the recorded image and said density value are set in accordance with a kind of recording medium used.

* * * * *

UNITED STATES PATENT AND TRADEMARK OFFICE

CERTIFICATE OF CORRECTION

PATENT NO. : 5,534,909

DATED : July 9, 1996

INVENTOR(S) : TADASHI HANABUSA ET AL.

It is certified that error appears in the above-identified patent and that said Letters Patent is hereby corrected as shown below:

COLUMN 5

Line 44, "same" should read --the same--.

COLUMN 6

Line 10, "up ward," should read --upward,--.

COLUMN 8

Line 44, "activates" should read --activate--.

COLUMN 9

Line 17, "learnt" should read --learned--.
Line 21, "learnt" should read --learned--.
Line 23, "learnt" should read --learned--.
Line 29, "fives" should read --five--.
Line 30, "peelings" should read --peeling--.

COLUMN 10

Line 26, "form" should read --from--.
Line 48, "form" should read --from--.
Line 58, "learnt" should read --learned--.

UNITED STATES PATENT AND TRADEMARK OFFICE

CERTIFICATE OF CORRECTION

PATENT NO. : 5,534,909

DATED : July 9, 1996

INVENTOR(S) : TADASHI HANABUSA ET AL.

It is certified that error appears in the above-identified patent and that said Letters Patent is hereby corrected as shown below:

COLUMN 11

Line 8, "specy" should read --smoothness--.

COLUMN 13

Line 19, "transfer" should read --transfer of--.
Line 38, "An" should read --A--.

COLUMN 14

Line 45, "means;" should read --means; and--.

COLUMN 16

Line 5, "An" should read --A--.

Signed and Sealed this

Seventeenth Day of December, 1996

*Attest:*

*Attesting Officer*

BRUCE LEHMAN

*Commissioner of Patents and Trademarks*